United States Patent [19]

Torbica et al.

[11] 4,401,409

[45] Aug. 30, 1983

[54] SELF-PRIMING CENTRIFUGAL PUMP

[75] Inventors: Ratko Torbica; Vladimir Bertok, both of Koper, Yugoslavia

[73] Assignee: Tovarna Motornih Vozil Tomos Koper, n.sol.o., Koper, Yugoslavia

[21] Appl. No.: 199,435

[22] Filed: Oct. 22, 1980

[30] Foreign Application Priority Data

Oct. 22, 1979 [YU] Yugoslavia ..... 2554/79

[51] Int. Cl.[3] ..... F01D 1/02; F01D 9/00

[52] U.S. Cl. ..... 415/211; 415/207

[58] Field of Search ..... 415/207, 208, 210, 211; 366/262–265

[56] References Cited

U.S. PATENT DOCUMENTS 3,103,177 9/1963 Gatto et al. ..... 415/211

4,057,361 11/1977 Renaud ..... 415/211

FOREIGN PATENT DOCUMENTS 214282 8/1959 Austria .

*Primary Examiner*—Philip R. Coe

*Assistant Examiner*—Timothy F. Simone

*Attorney, Agent, or Firm*—Fleit, Jacobson & Cohn

[57] ABSTRACT

The invention relates to a construction of the housing and arrangement of the rotor of a self-priming centrifugal pump whereby the suction from the suction part is carried out by means of the stator so that there has been eliminated the need for the suction part of the pump to be filled up with liquid prior to the pumping operation.

9 Claims, 7 Drawing Figures

SELF-PRIMING CENTRIFUGAL PUMP

Figure 1:
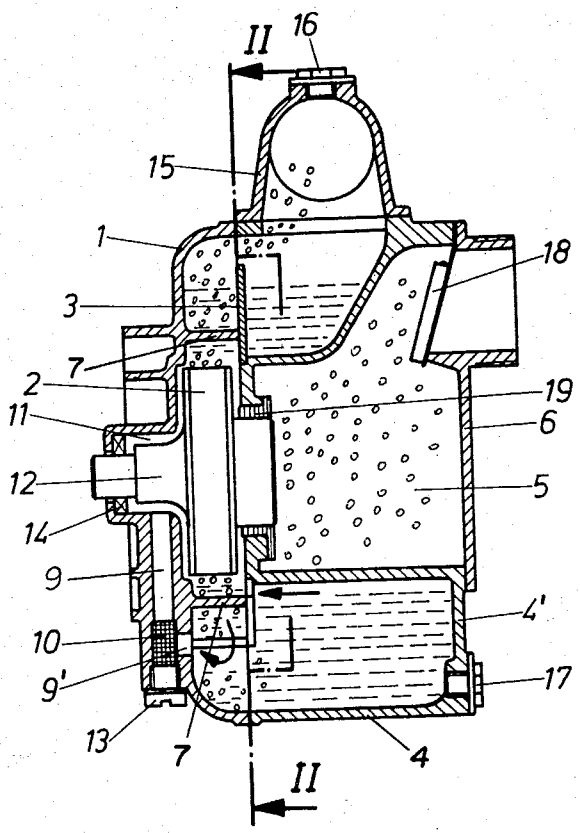

Object of the invention is a self-priming centrifugal pump having a housing enclosing a cavity in which there are arranged a rotor, means for supporting said rotor, a stator consisting of spirally shaped guiding vanes overlapping each other so as to form spiral divergent channels arranged in the structure of said housing and surrounding the periphery of said rotor, a suction part provided with a flap valve and connected to a suction pipe improved in such a way that there has been eliminated the need for the suction part of the pump to be filled up with liquid prior to the pumping operation.

There are known different constructions of self-priming centrifugal pumps. The common feature of known constructions resides in the fact that the compression part of the pump is separated from the suction part by means of a blocking liquid when the pump is out of operation, whereby during the starting of the pump the blocking liquid renders possible the creation of an underpressure and the forming of a mixture of air and liquid on the suction side of the pump. It further makes possible the furthering of this mixture to the pressure side of the pump, the separation of air and liquid on the pressure side, whereby the air escapes through the pressure duct. The de-aerated liquid once again returns to the part where the mixture of air and liquid is formed. In this way an auxiliary circulation is created which by means of the mixture of liquid and air removes the entire air quantity from the suction part of the pump.

Self-priming pumps provided with stator suction without additional movable or controlling elements are known. Such a pump is, e.g., disclosed in the Austrian Pat. No. 214.282. According to this embodiment the mixture of air and water is separated from the rotor and is conveyed to the pressure part by means of special stator guiding vanes extending to the part of the pump where the mixture is created in ring shape. In the pressure part of the pump the air is separated from the mixture and is conveyed through the pressure pipe whereby the remaining water returns to the rotor into the process of self-priming by means of recirculation.

The main drawback of the known self-priming centrifugal pumps lies in the limited possibility for the creation of vacuum in the suction part and henceforth in the limited suction height. Due to the warming up of the recirculated water, the suction height is the smaller the longer the time of self-priming operation. The second drawback of the known types of pumps is a lower efficiency and a higher cost due to the application of different disturbing elements by means of which the mixture of liquid and air is introduced into the recirculation ring of the fluid and therefrom into the pressure pipe.

It is the aim of the invention to shorten the time of self-priming operation of such a pump by means of constructional measures without the application of special means for the guided transport and introduction of the mixture into the recirculation liquid which would inevitably lower the efficiency of the normal pumping operation. The aim of the invention is also an inexpensive embodiment of the pump.

The aim set by the invention is solved by a pump provided with a housing functioning as stator, in the cavity of which there is arranged a rotor, said housing having a suction part, which is through a flap valve connected to the suction pipe. The guiding vanes of the stator, made in one piece with the housing, are embodied in the shape of a spiral, so that the end of one vane and the initial part of the subsequent vane overlap. The improvement consists in that the guiding vane on the suction side extends in axial direction over the rotor. The rear side of the rotor, together with the hub, is displaced into the cavity, which is by means of a channel connected to the lower part of the housing of the spiral following the end of the upper stator vane. The displacement of the rotor into the cavity is such that the rear side of the rotor centrifugally conveys the mixture contained in the cavity towards the outer circumference of the rotor whereby the circumferential wall of the cavity and the circumference of the rotor form an axial outlet slot through which the mixture pours out in the axial direction.

The initial part of the stator vane is prior to the merger into a spiral spaced from the rotor. The inner edge of the initial portion of the vane is adjusted to the rotor by a minimum clearance while a small part of the width of the vane protruding over the width of the rotor in axial direction of the rotor has its edge on the suction side (near the cover of the vanes) chamfered and opened against the direction of rotation of the rotor so as to form an angle A with respect to the tangent to the rotor.

Figure 2:
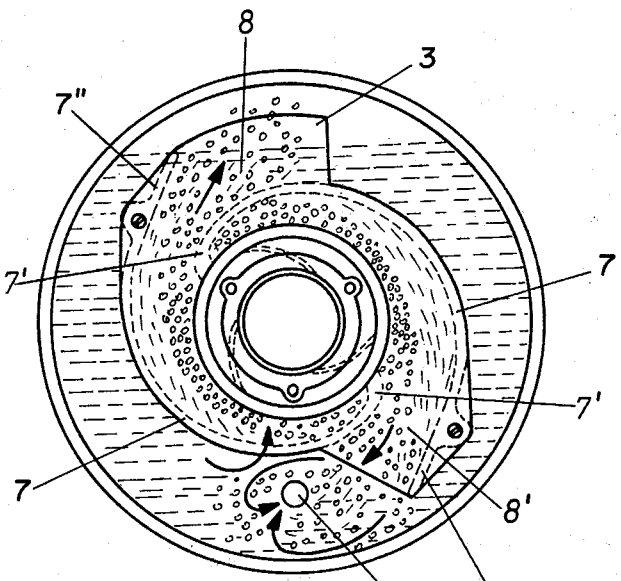
Figure 3:
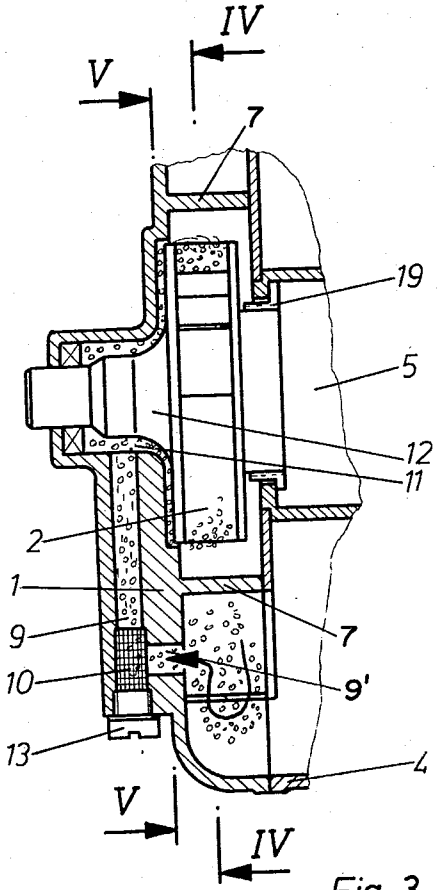
Figure 4:
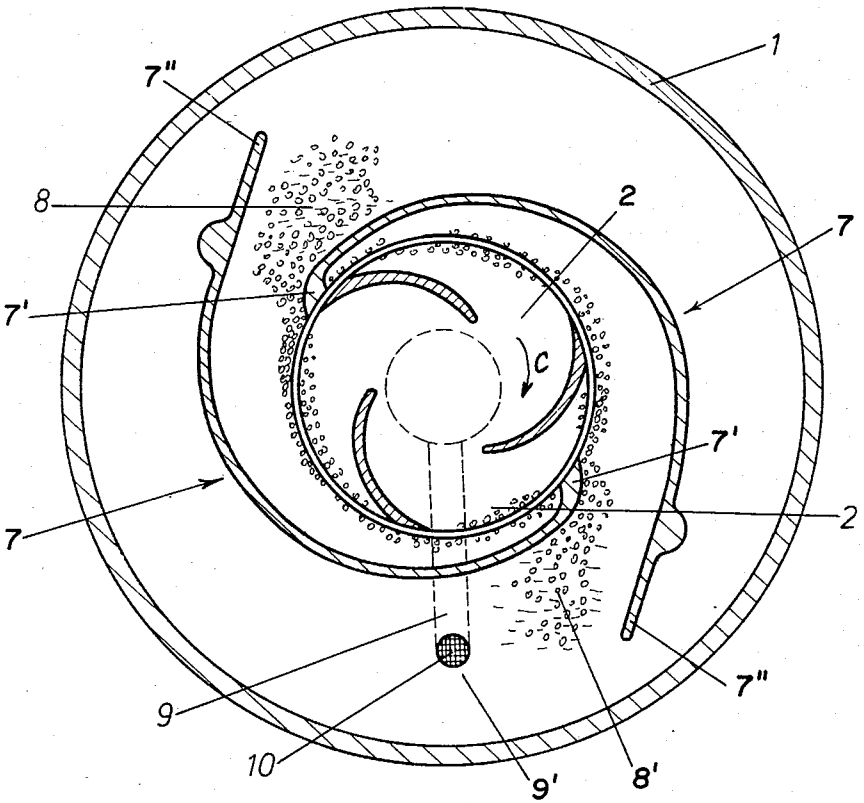
Figure 5:
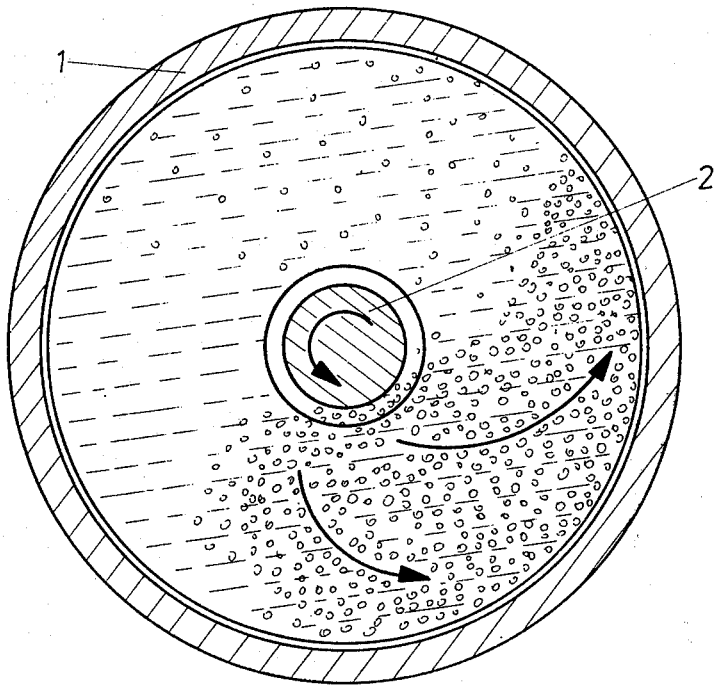
Figure 6:
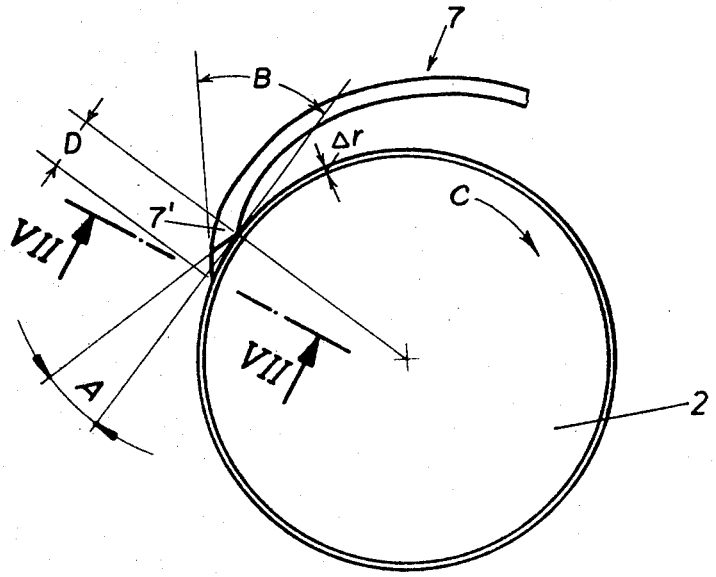
Figure 7:
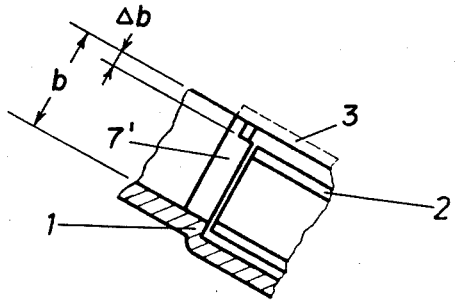

The invention will now be described on the basis of an embodiment and the corresponding drawing, in which show:

FIG. 1 a cross-section through the pump;

FIG. 2 a cross-section through the pump along the line II—II of FIG. 1;

FIG. 3 a partial cross-section through the pump from FIG. 1;

FIG. 4 a cross-section through the pump along the line IV—IV from FIG. 3;

FIG. 5 a cross-section through the pump along the line V—V from FIG. 3;

FIG. 6 a detailed view of the construction of the root of the spiral of the stator vane;

FIG. 7 a view of the initial part of the stator vane from the front side along the line VII—VII from FIG. 6.

The self-priming centrifugal pump according to the invention comprises a spiral housing 1 inside which there is sealingly arranged and journaled a rotor 2. In the spiral housing 1 the stator vanes 7 are covered by a cover 3, the spiral housing 1 extending and merging into a bell-like cover 4 provided with a pressure chamber 4' and a suction chamber 5 provided with a cover 6.

The stator of the pump is formed of the spiral housing 1, from the bottom of which there emerge two spiral guide vanes (FIGS. 1 and 2). The initial portions 7' of said guide vanes 7 are arranged adjacently and diametrically opposed to said rotor 2, so that each of said spiral guide vanes from its initial portion 7' extends spirally divergently with regard to the periphery of said rotor 2. The end portion 7'' of each vane 7, with an interspace, overlaps the initial portion 7' of the opposite vane 7 (located next to the initial portion 7' of said opposite vane) and forms with said opposite vane 7 the outlets 8, 8' of the spiral channel, which is defined by the periphery of said rotor 2 and said vane 7 and by the initial portion of the opposite vane 7.

Adjacent the outlet 8', limited by the upper spiral vane 7 and the end portion 7'' of the lower spiral vane 7, there is a passage 9' communicating with a vertical channel 9 (wherein a filter 10 is inserted) and with a cavity 11 located next to the hub 12 at the rear side of the rotor 2. In the channel 9 the filter 10 is mounted by means of bolt 13. From the surroundings the cavity 11 next to hub 12 is sealed by means of a sealing ring 14 mounted in the housing 1 where the shaft of the rotor 2 protrudes out of the housing 1. At the upper point of the housing 1 of the pump there is a screw 16 stopping the aperture for filling up, arranged in the pressure pipe connection part 15, while on the lowest point of the housing 1 there is an outlet stopping screw 17. The suction chamber 5 is by means of a flap valve 18 separated from the suction pipe mounted in the cover 6 of the suction chamber 5, the flap valve 18 opening inwardly into the suction chamber 5. The suction chamber is separated from the pressure part by the rotor 2 and by means of a labyrinth gland 19 arranged around the suction aperture of the rotor inside the bell-like cover 4.

The operation of the self-priming pump according to the invention is based on the known embodiment of the rotor 2 which makes possible the pumping of liquids at high efficiency. Before starting the pumping operation there is air in the suction pipe. The pump has to create such a vacuum in the suction part that corresponds to the suction height. This is achieved by a constant removal of the mixture liquid - air to the pressure part of the pump which is created on the outer circumference of the rotor after the pump has been started. The faster the creation and the removal of the mixture, the better the self-priming effect. For a prompt removal of the mixture the self-priming pump is provided with two guide vanes 7 having the shape of a spiral, the inner edge of the initial portion of said guide vane being arranged with a minimum clearance with respect to the rotor.

A quick removal of the outflowing mixed air-liquid from the periphery of the rotor 2 (impeller) is assured by a special design of the initial portion 7′ of guide vanes 7, which makes possible to repulse the mixture (leaving the rotor) deep into the annular mantle of the liquid surrounding the periphery of the rotor and, consequently, prevents the reverse flow of the mixture back to the rotor.

The design features of the initial portion 7′ of the guide vane 7, which can be seen from FIGS. 6 and 7, are as follows:

A relatively great length D of the face of the initial portion 7′ arranged opposite to the periphery of the rotor with a small radial clearance $\Delta r$ towards said periphery prevents the passing of the mixture through said radial clearance in the direction C of the rotation of the rotor 2.

The front face (seen in the direction C of the rotation of the rotor) of the initial portion 7′ of the guide vane 7 at first forms a relatively great angle B towards the tangent to the periphery of the rotor and then successively merges into the outer surface of the vane extending nearly in tangent direction towards the periphery of the rotor. The discharged mixture from the rotor is consequently repulsed away from its periphery (FIG. 6).

A relatively great depth (width) b of the vane 7 (seen in the axial direction of the rotor), so that on the suction side (i.e., on the side of the cover 3) the outer edge of the guide vane 7 extending over the width of the rotor (FIGS. 6, 7) in the zone of the initial portion 7′ is provided with a wedge-shaped cut $\Delta b$ under the angle A towards the tangent to the periphery of the rotor. This wedge-shaped cut is made at the very outer edge of the initial portion 7′ (seen in the axial direction of the rotor) adjacent to the cover 3. The width $\Delta b$ of said cut is relatively small in comparison to the entire width b of the guide vane 7 (FIG. 7). This wedge-shaped cut $\Delta b$ (diverging against the direction C of the rotation of the rotor) in the initial portion 7′ allows a forced reversal flow of a limited quantity of deaerated liquid to the peripheral zone of the rotor in order to cause additional turbulence in the mixture inside the rotor and to intensify the mixing.

The second feature is the suction of the mixture and of the liquid from the lower part of the pump through channel 9 and conveying the same into the cavity 11 next to the hub 12 of rotor 2. This suction is carried out by an auxiliary pump formed by a smooth rear wall of the rotor 2 arranged in the recessed seat of the spiral casing 1. Since this auxiliary pump has no blades, its efficiency depends upon a precise setting of the axial clearance between the rear wall of the rotor 2 and the bottom of the recessed part of the housing. By suction, the auxiliary pump removes all mixture and a part of pure liquid from the lower part of the housing, which results in a reduction of the air rate contained in the mixture. Due to this circumstance the mixture can receive additional quantities of air. The mixture sucked from the lower part of the housing 1 passes through the channel 9 and filter 10 into the lower part of the cavity 11 next to the hub 12, it being from here conveyed past the rounded off edge of the housing 1 and the rounded off transition of the hub prevailingly in the lower part of the auxiliary pump and from the outlet of the pump axially on the circumference of the rotor 2 and into the mixture being created at the lower part of the rotor 2. An axial outlet of the mixture from the auxiliary pump is achieved by an arrangement of the rotor 2 into the housing 1 in such manner that the rotor 2 with its rear side reaches into the recess of the housing 1, it thus forming an axial outlet slit. The mixture axially removed from the auxiliary pump mixes with the existing mixture on the circumference of the rotor, it thereby causing additional absorption of air which together with the mixture separates from the rotor 2 at the inner edge of the upper guiding vane 7, it separating from the liquid and passing through the pressure pipe connection part 15.

When the pump is out of operation, the emptying of the water from the suction part is prevented by the flap valve 18. At restarting the pump in this way, only that part of self-priming is necessary which restores the liquid lost due to the untightness of the suction part.

What is claimed is:

1. A self-priming centrifugal pump comprising a housing enclosing a cavity, a rotor positioned in said cavity and having a hub, means for rotatably supporting said hub of said rotor, a stator consisting of spirally shaped guide vanes overlapping each other so as to form first and second spiral divergent channels positioned in said housing and surrounding the periphery of said rotor, a suction port connectable to a suction pipe for introducing fluid into said cavity, a flap valve positioned to close said port, the guide vanes of the stator extending in an axial direction over the peripheral width of the rotor towards the suction side of the pump, the rear side of the rotor and the hub being placed into the cavity, a passage formed in the lower part of the housing, and a third channel communicating with said passage, said passage being located downstream of an end portion of one of said guide vanes, with respect to the direction of rotation of the rotor, and establishing communication between one of said divergent channels and said third channel, said third channel receiving fluid through said passage and communicating with a portion of the cavity containing said rotor to thereby return fluid directed away from said rotor by said one of said guide vanes to the periphery of said rotor.

2. A self-priming centrifugal pump according to claim 1, wherein an extension of the hub of the rotor into the cavity is such that the mixture contained in the cavity is centrifugally conveyed toward the outer circumference of the rotor, which together with the circumferential wall of the cavity and the bottom of the housing form an axial outlet slot for the mixture discharged at the rear side of the wall of the rotor.

3. A self-priming centrifugal pump according to claim 1, wherein each of the guide vanes has a front face with an initial portion extending at a relatively large angle (B) prior to merger into a spiral extending substantially in a tangential direction to the rotor, the edge of the initial portion of the vane being located adjacent the periphery of the rotor with a minimum clearance ($\Delta r$) therebetween to minimize fluid flow between the rotor and said initial portions of said vanes, the initial portion of the vane protruding over the width of the rotor on the suction side of the pump with an inner edge chamfered at an angle (A) towards the tangent to the rotor, so that the divergent part of the angle is directed against the direction (C) of the rotation of the rotor whereby a limited volume of deaerated liquid is forced to flow in a reverse direction to the peripheral zone of the rotor to increase turbulence.

4. A self-priming centrifugal pump according to claim 1, wherein there are two guide vanes, each of said guide vanes having an initial portion closely spaced from the periphery of the rotor and extending over a portion of the periphery to minimize fluid flow between the periphery and the initial portion, said one of said guide vanes having an initial portion extending upwardly from the periphery of the rotor, an intermediate portion extending upwardly from the initial portion and then downwardly in the shape of a spiral, and a downwardly extending end portion overlapping the initial portion of the other guide vane, said one guide vane defining a channel directing fluid flow towards said passage.

5. A self-priming centrifugal pump comprising:

housing means defining an internal cavity;

a hub and rotor disposed for rotation in said cavity;

a suction port for introducing fluid into said cavity;

a pressure port for egress of fluid from said cavity;

a stator extending inwardly into said cavity from said housing means, said stator comprising two spiral shaped vanes, each vane having an initial portion closely spaced from the periphery of said rotor so as to minimize fluid flow therebetween and an end portion overlapping the initial portion of the other vane, the vanes defining flow paths extending outwardly from the periphery of the rotor with one of the flow paths being directed towards a lower portion of the cavity and another of the flow paths being directed towards an upper portion of said cavity;

means for defining a fluid flow path having an inlet adjacent the outlet of said one flow path, an intermediate portion, and an outlet for directing fluid removed from the lower portion of the cavity to mix with an existing fluid mixture on the circumference of the rotor.

6. A self-priming centrifugal pump according to claim 5, wherein said intermediate portion of said fluid flow path includes a cavity surrounding the hub of the rotor.

7. A self-priming centrifugal pump according to claim 6, wherein a surface of said rotor facing said hub defines a portion of said fluid flow path.

8. A self-priming centrifugal pump according to claim 5 or 6, further comprising means for preventing egress of fluid from said cavity through said suction port.

9. A self-priming centrifugal pump having a housing enclosing a cavity, in which there are arranged a rotor, means for supporting said rotor, a stator consisting of upper and lower spirally shaped guide vanes overlapping each other so as to form spiral divergent channels arranged in the structure of said housing and surrounding the periphery of said rotor, a suction port provided with a flap valve and connectable to a suction pipe, characterized in that the guide vanes (7) of the stator extend in axial directions over the peripheral width of the rotor (2) towards the section side and that the rear side of the rotor (2) together with the hub (12) is placed into the cavity (11), which by means of a passage (9') and a channel (9) is connected to the lower part of the housing (1), so that said passage (9') and said channel (9) are arranged downwards of the end portion (7'') of the upper guide vane (7), relating to the direction (C) of the rotation of the rotor (2).

* * * * *